US005833057A

United States Patent [19]

Char et al.

[11] Patent Number: 5,833,057

[45] Date of Patent: Nov. 10, 1998

[54] APPARATUS FOR PACKAGING AND SHIPPING BIOLOGICAL FLUID SAMPLES COLLECTED IN VIALS

[76] Inventors: Aka Loka Char, 146 Eaglewood Drive, Bedford, Nova Scotia, Canada, B4A 3B2; Barry Sibley, Site 16 A, Box 9. R.R. #1, Enfield , Nova Scotia, Canada, B0N 1N0

[21] Appl. No.: 848,687

[22] Filed: Apr. 28, 1997

[51] Int. Cl.[6] ..... B65D 81/26; B65D 81/02

[52] U.S. Cl. ..... 206/204; 206/366; 206/370; 206/521; 206/523; 229/148

[58] Field of Search ..... 206/204, 366, 206/370, 443, 570, 571, 523, 521, 586, 591; 211/74; 220/293, 297, DIG. 13; 215/332; 229/148

[56] References Cited

U.S. PATENT DOCUMENTS

| | | | |
|---|---|---|---|
| 1,277,459 | 9/1918 | Myers | 229/148 |
| 2,072,753 | 3/1937 | Ikeda et al. | 229/148 X |
| 3,826,358 | 7/1974 | Butler et al. | 206/204 |
| 4,240,547 | 12/1980 | Taylor | 206/204 |
| 4,932,533 | 6/1990 | Collier | 211/74 X |
| 4,971,867 | 11/1990 | Jensen et al. . | |
| 5,024,865 | 6/1991 | Insley | 206/204 X |
| 5,029,699 | 7/1991 | Insley et al. | 206/204 |
| 5,040,678 | 8/1991 | Lenmark, Sr. et al. | 206/443 |
| 5,160,021 | 11/1992 | Sibley et al. . | |
| 5,186,900 | 2/1993 | Jensen et al. . | |
| 5,291,997 | 3/1994 | He et al. | 206/370 |
| 5,409,667 | 4/1995 | Elson . | |
| 5,579,929 | 12/1996 | Schwartz . | |

*Primary Examiner*—Byron Gehmon
*Attorney, Agent, or Firm*—Pearne, Gordon, McCoy, Granger, LLP

[57] ABSTRACT

An apparatus for packaging and shipping biological fluid samples collected in vials is disclosed. The apparatus includes an absorbent body for supporting a plurality of vials, a packaging container for surrounding and protecting the absorbent body when at least one of the vials is received and supported therein, a shipping container for surrounding and protecting at least one of the packaging containers and a shipping carton for surrounding and protecting the shipping container during shipment from a facility where the biological samples are collected to a facility for analyzing the biological samples. The apparatus in accordance with the invention is particularly useful in clinical drug trials, phases 1 to 4. The apparatus is designed to be used with robotic analyzers which automatically locate and remove the vials from the absorbent body in a predefined order in accordance with an index associated with the top surface of the body. Any biological fluid leaked or spilled from a vial is absorbed by the absorbent body to ensure that potentially infectious biological fluids are not discharged into the environment during shipping or handling. The advantage is a safe, inexpensive system for handling and shipping biological fluid samples collected in vials which permits automated sample analysis without auxiliary handling.

19 Claims, 4 Drawing Sheets

APPARATUS FOR PACKAGING AND SHIPPING BIOLOGICAL FLUID SAMPLES COLLECTED IN VIALS

TECHNICAL FIELD

The present invention relates generally to an apparatus for collecting and transporting biological fluid samples, and in particular to an apparatus for collecting and transporting biological fluid samples which is adapted for use with automated analysis equipment.

BACKGROUND OF THE INVENTION

Biotechnology and modem medical research have lead to the development of new drug treatments at unprecedented rates. Such treatments often target communicable, highly-infectious and potentially fatal diseases such as Acquired Immune Deficiency Syndrome (AIDS), virulent strains of streptococcus, tuberculosis, hepatitis, etc. In order to protect the public and ensure that drugs sold to the public are safe and effective for their claimed purpose, governments require lengthy and involved drug testing and certification programs. Those programs include clinical trials generally consisting of at least four phases where infected individuals are treated to determine the efficacy and safety of the drug. In order to contain costs and expedite the clinical trial process, automated robotic analyzers have been developed for automatically analyzing fluid samples collected from treated patients. Since such fluid samples may be infected with potentially lethal disease agents they must be carefully handled during collection, shipping and analysis to ensure that the infectious and potentially lethal fluids do not escape into the environment where they could potentially infect persons coming into contact with them.

Containers for transporting diagnostic specimens or dangerous substances are known. Such containers are taught for example in U.S. Pat. No. 4,917,867 which issued on Apr. 17, 1990 to Jensen et al. and U.S. Pat. No. 5,186,900 which issued on Feb. 16, 1993 to Jensen et al., as well as U.S. Pat. No. 5,160,021 which issued on Nov. 3, 1992 to the applicants. U.S. Pat. Nos. 4,917,867 and 5,160,021 describe containers which include synthetic foam inserts for supporting and cushioning vials containing biological fluid samples. While these containers are effective for their intended purpose, they are not designed to handle large quantities of individually packaged samples such as commonly encountered in clinical drug trials. While a plethora of racks for vials having specialized features, such as exemplified by U.S. Pat. No. 5,409,667 which issued on Apr. 25, 1995 to Elson are known, such racks are not suitable for the handling and shipping of infectious biological fluid samples because they offer no protection in the event that spillage or leakage occurs.

There therefore exists a need for an apparatus for packaging and shipping biological fluid samples collected in vials when the biological samples are potentially infectious and the contents of the vials are intended to be analyzed by automated robotic analysis equipment.

SUMMARY OF THE INVENTION

It is an object of the invention to provide an apparatus for packaging and shipping biological fluid samples collected in vials which is adapted for use with automated analysis equipment.

It is a further object of the invention to provide an apparatus which surrounds the vials containing biological fluid samples with an absorbing material for absorbing and retaining any biological fluids which may leak from the vials.

It is yet a further object of the invention to provide an apparatus for packaging and shipping biological fluid samples collected in vials which is inexpensive to manufacture but provides the capacity for shipping large quantities of potentially infectious biological fluid samples in a single container.

These and other advantages are provided in an apparatus for packaging and shipping biological fluid samples collected in vials comprising an absorbent body having a bottom surface, a top surface and at least one sidewall, the top surface including a plurality of means that extend therefrom into the body for respectively receiving and retaining a one of the vials;

- a packaging container for surrounding and protecting the absorbent body when at least one of the vials is received in at least one of the cavities in the top surface thereof;
- a shipping container for surrounding and protecting at least one of the packaging containers, the shipping container including means for securing the at least one packaging container therein so that the packaging container is not displaced during shipping; and
- a shipping carton for surrounding and protecting the shipping container from damage during shipping.

The apparatus in accordance with the invention therefore includes an auto-absorbent body used for supporting and protecting the vials. The absorbent body is preferably an auto-absorbent body. In this specification, the term "auto-absorbent body" means a body made of a fibrous spongy material which is hydrophilic and will absorb liquids on contact without being compressed or otherwise induced to absorb the liquids. The absorbent body is preferably a square parallelepiped body made of a cellulose sponge, or the like. The absorbent body has a top surface which includes means that extend therefrom into the body for respectively receiving and retaining the vials. In accordance with the preferred embodiment of the invention, the means for receiving and retaining the vials are cylindrical sockets which are die cut from the top surface of the body. The sockets receive and retain the vials in the same way as they are received and retained in a test tube rack, for example. Also associated with the top surface of the absorbent body is an index to identify each vial. The index is preferably simply a numerical code which identifies each cylindrical socket. When a cellulose sponge structure is dry, it is relatively rigid. The absorbent body in accordance with the invention can therefore be used as a test tube rack that may be handled as an independent unit during the collection of biological fluid samples so that the collected vials are safely protected during the collection process and spilled or leaked biological fluids are absorbed by the absorbent body.

When enough biological fluid samples have been collected to warrant shipment to an analysis facility, the absorbent body in which the vials are stored is first packed in a packaging container which is in turn packed in a shipping container. The shipping container preferably accommodates four packaging containers. The shipping container is preferably an insulated container made of a polystyrene foam, or the like. The packing containers are retained in a fixed position within the shipping container by a plasticized fiberboard retainer member which preferably has upturned side edges that cooperate with the lid of the shipping container to retain the packing containers in their shipping position. The fiberboard retainer member defines a space between a top of the packaging containers and the lid of the shipping container which is preferably filled with a cooling compound such as dry ice to ensure that the biological samples are kept in a frozen condition during transit. Prior to shipping, the shipping container is placed in a shipping carton of heavy fiberboard which protects the shipping container during transit. When the samples arrive at an analysis facility, the shipping carton is removed and the packaging containers are removed from the shipping container and positioned in a predetermined orientation in a robotic analyzer which extracts the vials in a predefined order and records the analysis results to a data file using an index associated with the predefined order in which the vials were extracted.

If the vials are pressure resistant vials, the packaging container may be a square plastic container with a press fit lid which is fluid impervious at atmospheric pressure but not necessarily pressure resistant. If, however, the vials are not pressure resistant, the packaging container is preferably a pressure resistant container having a closure which includes an O-ring seal to ensure that the biological fluids do not leak from the packaging container if it is exposed to pressures which exceed one atmosphere. Such pressure resistant packaging containers are preferably either cylindrical or square containers with a cylindrical neck. The lids for such containers are either locked on by a spiral thread, a twist lock arrangement or the like.

BRIEF DESCRIPTION OF THE DRAWINGS

The preferred embodiment of the invention will now be explained by way of example only and with reference to the following drawings, wherein.

DETAILED DESCRIPTION OF THE PREFERRED EMBODIMENT

Figure 1:
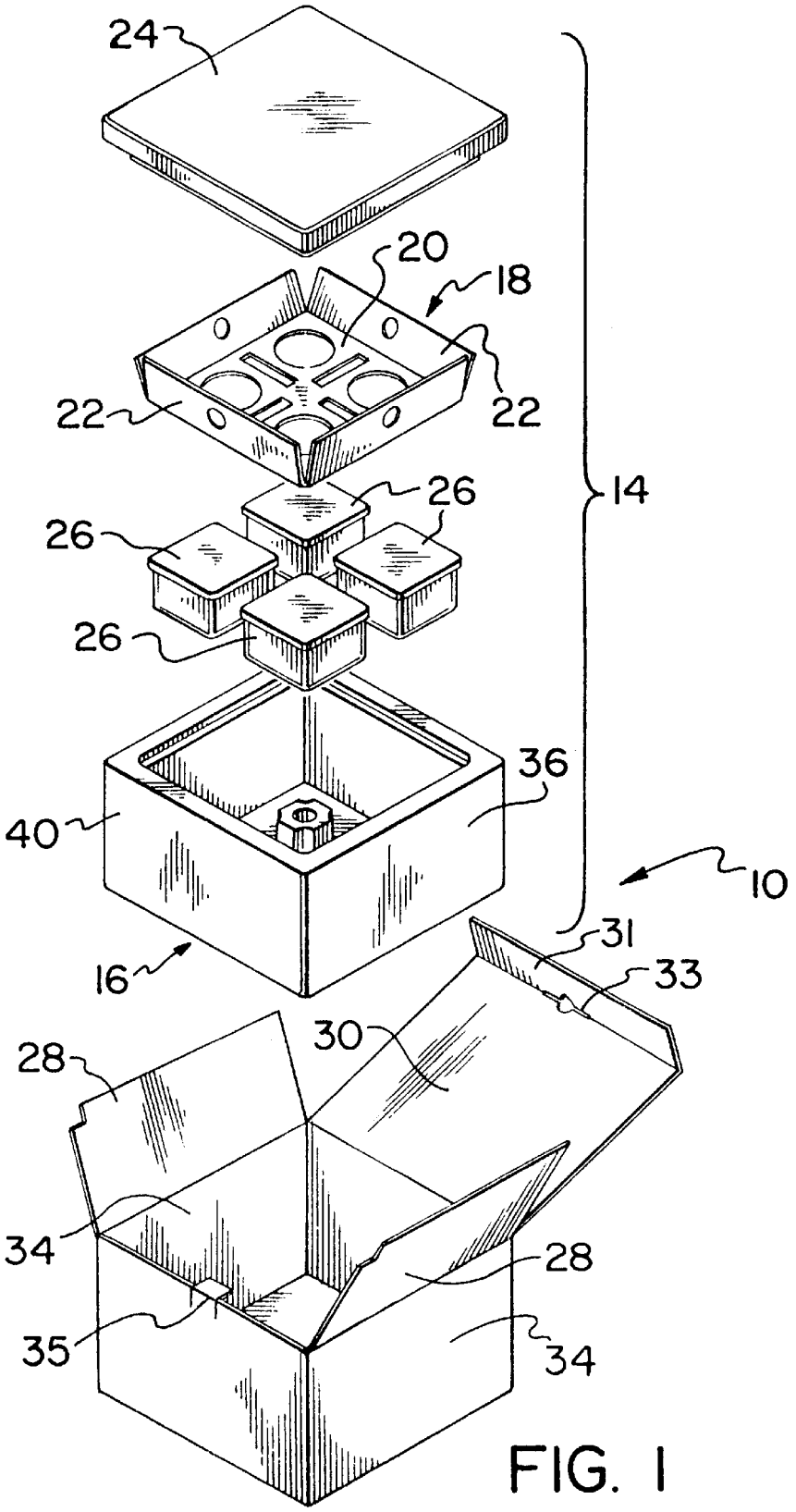
FIG. 1 is an exploded perspective view of the apparatus is accordance with the invention.

FIG. 1 shows an exploded perspective view of the apparatus for packaging and shipping biological fluids samples collected in vials in accordance with the invention, which is generally indicated by the reference 10. The apparatus includes a shipping carton 12 which surrounds and protects a shipping container generally indicated by the reference 14. The shipping container 14 includes a hollow molded container body 16 preferably made from a shock absorbent insulating rigid material such as polystyrene foam. The shipping container further includes a retainer member 18 which is preferably a corrugated plastic board or a plasticized fiberboard having a base 20 and upturned side edges 22. The base 20 is preferably sized to fit relatively snugly within the hollow molded container body 16. The upturned side edges 22 cooperate with a shipping container lid 24 to retain packaging containers 26 in the shipping containers 16 as will be explained below with reference to FIG. 2. The function and structure of the packaging container 26 are explained below with reference to FIGS. 3 and 4.

Figure 2:
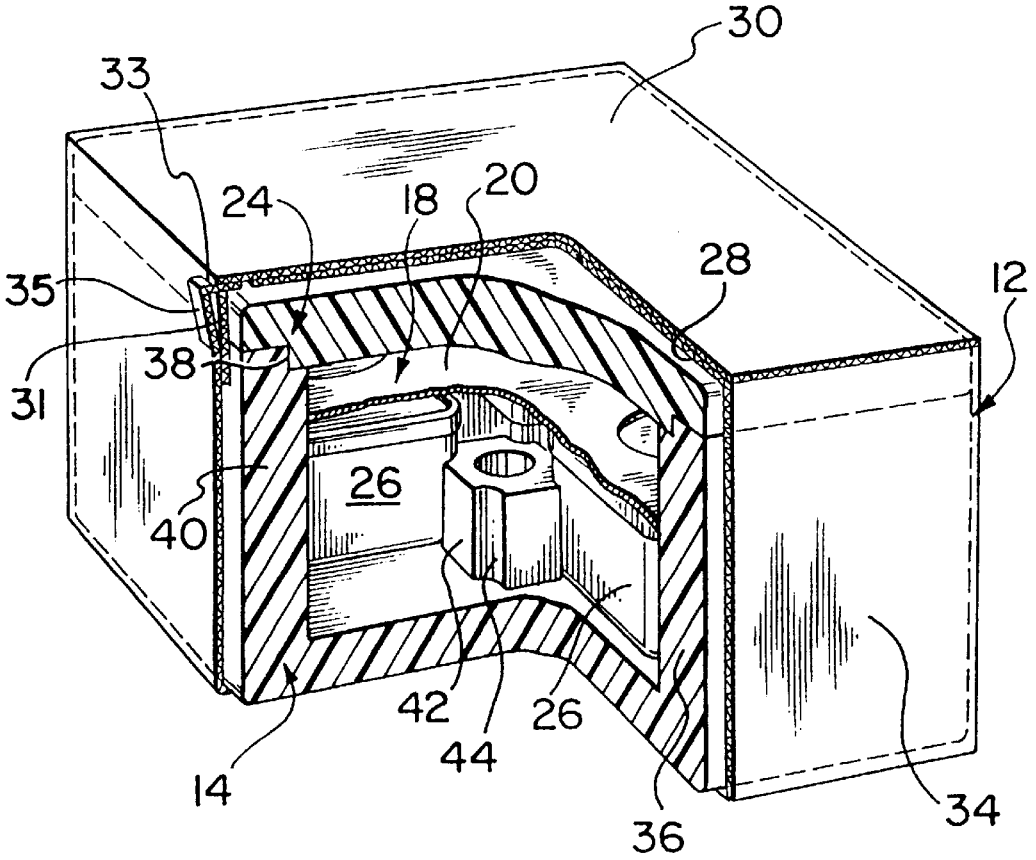
FIG. 2 is a cut away perspective view of the assembled apparatus in accordance with the invention.

FIG. 2 shows a partially cut away perspective view of an assembled apparatus in accordance with the invention, ready for shipping. As explained above, the assembled apparatus includes an outer shipping carton 12 preferably made of a heavy fiberboard which is a 200 psi B or C flute fiberboard, well known in the art. The shipping carton 12 includes inner top panels 28 (see also FIG. 1) which are integral with sidewalls 30. When the shipping container 14 is placed in the shipping carton 12, the inner top panels are folded over the top of the shipping container 14 and the outer top cover 30 is folded over the top panels 28. The outer top cover 30 includes an integral flap 31 hingedly connected along its outer edge. A slit 33 cut at the fold line of the flap 31 accepts a locking tab 35 which is an integral part of the front wall of the shipping carton 12. A small hole cut at the slit 33 facilitates entry of the locking tab 35. The locking tab 35 on the front wall of shipping carton 12 securely locks the outer top cover 30 in a closed position so that the shipping carton 12 passes United States government regulations respecting the shipment of infectious substances without being taped or otherwise secured. This is a significant advantage because if tapes or other securing means are used, not only must those tapes or other securing means be certified as safe, only the certified tape or other closure means may be used to close the container used for shipping infectious substances. The shipping carton 12 in accordance with the invention therefore eliminates any requirement for certified tape, etc. and simplifies the process of preparing the carton for shipment as well as ensuring that shipment preparation is not dependent on some auxiliary supply item.

The shipping container body 16 is preferably an EPS (Expanded Polystyrene) container made from a polystyrene having a density of at least about 1.3 lb/cu.ft., a compression strength of at least about 16 psi (110 Kpa) at 10% deformation; an R value of about 4 per inch at 75° F. (24° C.); and, a fractural strength of about 35 psi (240 Kpa). Such material is commercially available.

The lid 24 of the shipping container 14 preferably has a rabbet 38 that cooperates with a corresponding rabbet at a top of a sidewall 40 of the shipping container 14. The rabbet 38 locks the lid 24 to the shipping container 14 so that it is not horizontally displaceable and it offers a resistance to vertical displacement which is readily overcome so that the shipping container 14 is easily opened but the lid 24 does not readily fall off even if the container 14 is inadvertently inverted.

As explained above, the packaging containers 26 are retained in a bottom of the shipping container 14 by a retainer member 18 which has upstanding side edges 22 (see FIG. 1) that cooperate with the lid 24 so that the base 20 of the retainer member 18 rests against a top of the packaging containers 26. The shipping container 14 preferably includes an integrally molded post 42 with inwardly grooved corners 44 which cooperate with corners of the packaging containers 26 to retain the packaging containers 26 in a stable spaced-apart relationship in the shipping container 14. The shape and configuration of the post 42 will depend upon the shape and configuration of the shipping containers 26 which in turn depends upon the properties of the vials to be shipped, as will be explained below with reference to FIGS. 3 and 4. In any event, it is preferable that the shipping containers 26 are supported in a substantially fixed spaced-apart relationship within the shipping container 14, regardless of how such a relationship is maintained.

Figure 3:
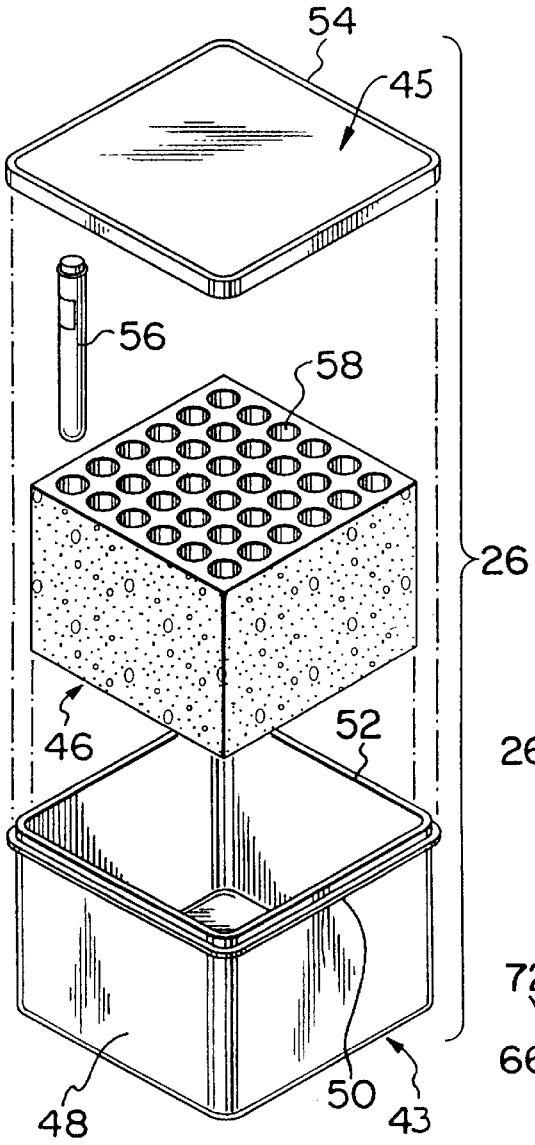
FIG. 3 is an exploded perspective view of an absorbent body and a packaging container for housing the absorbent body in accordance with the invention.

FIG. 3 shows an exploded view of a preferred embodiment of a packaging container 26 in accordance with the invention. The packaging container 26 includes a container base 43, a container lid 45 and it surrounds and protects an absorbent body 46. The container base 43 is preferably a hollow molded square container made from a tough resilient transparent plastics polymer such as high density polyethylene, or the like. The packaging container base 43 includes four sidewalls 48 which are preferably of equal length. A peripheral rim 50 cooperates with the lid 45 to ensure a fluid tight seal at atmospheric pressure as does an out turned peripheral lip 52 at a top edge of the container sidewalls. The lid 45 of the packaging container 26 is similarly made of a tough, resilient thermoplastic resin and has a peripheral sealing edge 54 which cooperates with the peripheral lip 52 and the peripheral rim 50 of the packaging container base 43 to ensure a fluid tight seal at atmospheric pressure. The packaging container 26 surrounds and protects the absorbent body 46 which is preferably an absorbent body made of cellulose sponge. Cellulose sponge is commonly used for industrial and domestic cleaning applications and is available from the DuPont Corporation, United States of America, the fluid absorption properties of cellulose sponge are excellent. The sponge absorbs about 25 times its weight in fluid. As explained above, unlike plastic resin foams which are naturally hydrophobic, cellulose sponge is a hydrophilic substance that is auto-absorbing, meaning that it absorbs fluid on contact without being compressed or otherwise induced to absorb. As well, in a dry state, cellulose sponge is a substantially rigid material and has good structural properties. It is therefore an ideal material for supporting vials 26 such as pressure resistant blood tubes, for instance. The absorbent body 46 includes a plurality of die cut cylindrical cavities 58. The die cut cylindrical cavities 58 are the preferred means of supporting the vials 56 because they securely support the vials in a spaced-apart cushioned relationship and resist removal of the vials without offering undue resistance to removal, which facilitates handling of the vials by automated equipment such as robotic analyzers for which the invention is primarily intended. An absorbent body 46 of a cellulose sponge is therefore an ideal material for the intended purpose since the cellulose sponge material readily absorbs any fluid leaked from a vial 56 or accidently spilled while handling a vial 56, while providing good support for the vials. The body 46 is rigid enough to be handled independently of the packaging container 26 so that it may accompany health practitioners who take fluid samples from patients to provide secure protection against leakage of potentially infectious biological fluids into the environment.

Although die cut cylindrical cavities 58 are preferred for supporting the vials 56, other means may be used for the same purpose, such as various configurations of slits, slots or die cut cavities.

Figure 4:
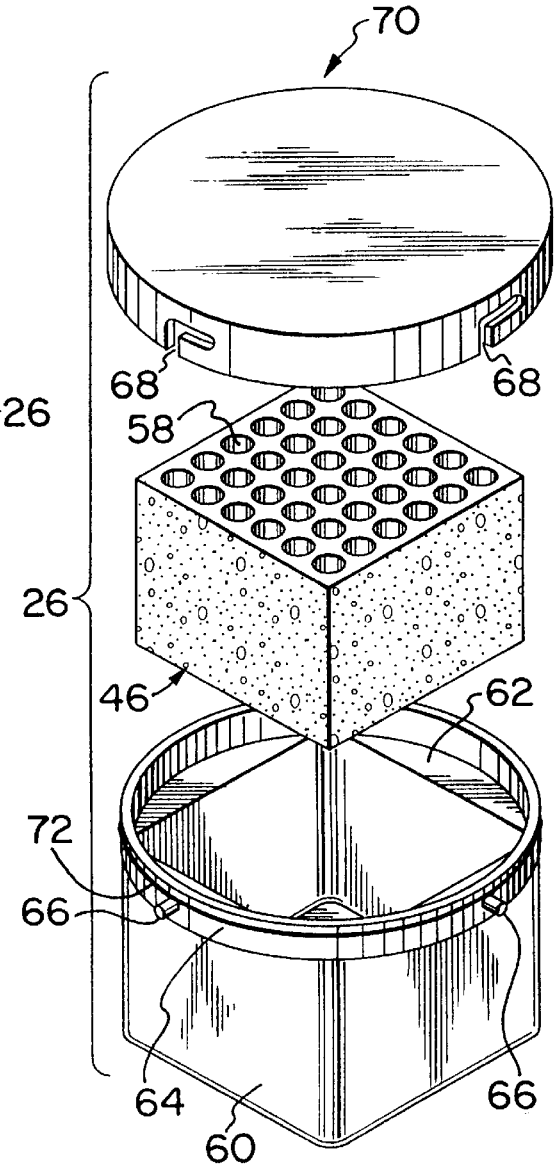
FIG. 4 is an exploded perspective view of an alternate packaging container for housing an absorbent body in accordance with the invention.

FIG. 4 shows an alternate embodiment of a packaging container 26 in accordance with the invention. The packaging container 26 in accordance with this embodiment is intended for shipping vials 56 which are pressure sensitive. Certain vials used in drug trials are pressure rated to meet regulated standards for the shipping of infectious substances while other vials do not have an equivalent pressure rating. If the vials to be shipped do no have an approved pressure rating, they must be shipped in a packaging container which is pressure rated to regulatory standards. The packaging container 26 is adapted to provide such pressure rating. Since the absorbent body 46 is preferably rectangular to facilitate handling by automated robotic sample analyzers, the packaging container base 60 of this embodiment is square on the bottom and includes a circular peripheral lip 62 which extends horizontally from a top edge of the square packaging container base 60. A diameter of the circular peripheral lip is preferably substantially equal to a diagonal of the square base 60. Integrally molded to a peripheral edge of the circular lip 62 is a vertical cylindrical neck 64 which preferably includes a plurality of lugs that engage corresponding locking grooves 68 to lock a circular cover 70 on the cylindrical neck 64. The cylindrical neck 64 includes a peripheral groove located above the lugs 66 which accommodates an O-ring 72 to provide a pressure tight seal for the container. Alternatively, the cover 70 may be secured to the cylindrical neck 64 by a spiral thread (not shown), or the like. The packaging container of this embodiment is likewise molded from a tough resilient thermoplastic and is preferably transparent but the container must be of a heavier gauge than the packaging container shown in FIG. 3 because it must be able to withstand extended exposure to elevated pressures and/or vacuums without leakage.

Figure 5:
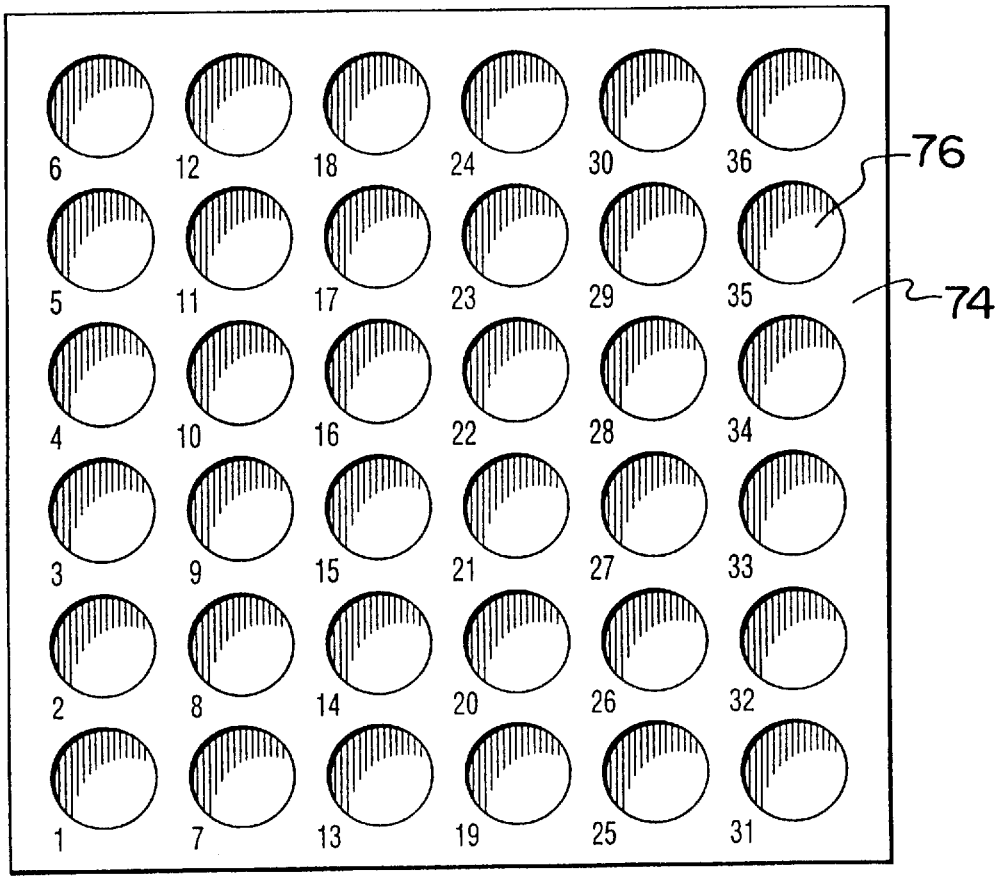
FIG. 5 is a top plan view of the absorbent body in accordance with the invention showing a preferred index overlying a top of the absorbent body.

FIG. 5 shows a top plan view of an overlay which is preferably secured to the top surface of the absorbent body 46 to provide an index for health care professionals who collect fluid samples and store the collection vials in the absorbent body 46. The index 74 is preferably printed on a transparent plastic film, or the like, and die cut with openings 76 that correspond to the cylindrical cavities 58 in the absorbent body 46. The index 74 is preferably transparent so that any leakage of the biological fluids can be observed through the index when the lid is removed from the packaging containers 26. Alternatively, an index may be printed directly on the top surface of the absorbent body 46, or otherwise applied to it.

As noted above, the apparatus in accordance with the invention is primarily intended for use in shipping potentially infectious biological fluids collected in association with clinical drug trials, phases 1–4. In such trials, numerous biological fluid samples, such as blood samples, are collected and stored at health care facilities for later diagnosis at centralized diagnostic facilities which typically use automated robotic analyzers. In order to ensure that fluid samples are safely stored and shipped to such centralized analysis facilities, the apparatus described above was invented. The apparatus not only provides a secure support for vials containing potentially infectious biological fluid samples but also enables and facilities robotic analysis of such samples. In use, the samples are collected from patients involved in drug trials. Preferably, the absorbent body 46 accompanies the health practitioner collecting the samples and is used to support the fluid sample vials throughout each step of the operation. Typically, after collection, such sample vials are stored in a local freezer until a predetermined quantity of sample vials are amassed, at which time the sample vials are packaged in one or more packaging containers 26 which are in turn placed in one or more shipping containers 14. The retainer member 18 (see FIG. 1) is placed over the packaging containers 26 and the space between the base 20 of the retainer member 18 and the lid 24 of the shipping container 14 is typically filled with a cooling compound such as dry ice to keep the vials frozen during transport. Each shipping container 14 is placed in a shipping carton 12 which is closed, addressed to the analysis facility and shipped. When the shipping carton 12 arrives at the analysis facility, the shipping carton 12 is opened, the shipping container 14 is removed, the lid 24 is removed from the shipping container 14, the retainer member 18 is removed from the shipping container 16 and the packaging containers 26 are removed.

The packaging containers 26 are stored and sequentially presented to robotic analyzers in a predetermined orientation so that the analyzers remove and analyze the contents of each vial in a predetermined sequence and the data from analysis is stored in the predetermined sequence so that it can be matched with patient data, which generally accompanies each shipment. The coordination of the index 74 applied to the top surface of each absorbent body 46 with patient identifiers and analysis data is well known in the art and is not part of this invention.

The apparatus in accordance with the invention provides a cost effective, secure means of handling and shipping potentially infectious biological fluids that permits and promotes end-to-end handling of the vials containing such fluids in a most efficient manner. When used in accordance with the design purpose, vials may be moved from a drug trial patient to a robotic analyzer without rehandling or repackaging. In prior art systems, vials were stored at the accumulation site then packaged in a shipping container where they were unpackaged at the central analysis facility and placed in receptacles that could be handled by robotic analyzers. All of that handling and repackaging contributed to a margin of error as well as to labour involved in conducting drug trials. With the simple end-to-end system facilitated by the apparatus in accordance with the invention, the possibility of error is reduced to a minimum since handling of vials is minimized and repackaging is eliminated.

Changes and modifications to the above-described preferred embodiments may be apparent to those skilled in the art. The embodiments described are intended to be exemplary only and not limiting to the scope or spirit of the invention.

We claim:

1. An apparatus for packaging and shipping biological fluid samples collected in vials, comprising:

an absorbent body having a bottom surface, a top surface and at least one sidewall, the top surface including at least one vial;

a packaging container for surrounding and protecting the absorbent body;

a shipping container for surrounding and protecting the packaging container, the shipping container including a lid, a bottom wall and means for securing the packaging container therein so that the packaging container is not displaced during shipping, the means for securing the packaging container comprising a corrugated plastic board retainer having upturned side edges which cooperate with the lid of the shipping container to hold the packaging container against the bottom of the shipping container; and a shipping carton for surrounding and protecting the shipping container from damage during shipping.

2. An apparatus for packaging and shipping biological fluid samples collected in vials as claimed in claim 1 wherein the absorbent body is an auto-absorbent body of cellulose sponge.

3. An apparatus for packaging and shipping biological fluid samples collected in vials as claimed in claim 2 wherein the cellulose sponge body is a square parallelepiped.

4. An apparatus for packaging and shipping biological fluid samples collected in vials as claimed in claim 3 wherein the vials are sealed pressure resistant fluid specimen vials and the packaging container is a square container of a plastics polymer with a press fit lid that engages the container in a fluid impervious seal at atmospheric pressure.

5. An apparatus for packaging and shipping biological fluid samples collected in vials as claimed in claim 1 wherein the means for receiving and retaining the at least one vial is a cylindrical cavity die cut from the top surface of the absorbent body.

6. An apparatus for packaging and shipping biological fluid samples collected in vials as claimed in claim 1 wherein the vials are pressure sensitive fluid specimen vials and the packaging container has a pressure resistant lid sealed by an O-ring seal.

7. An apparatus for packaging and shipping biological fluid samples collected in vials as claimed in claim 6 wherein the packaging container is cylindrical and the lid is round, and the lid is secured to the container by cooperating closure means which includes at least one closure component on each of the lid and the container.

8. An apparatus for packaging and shipping biological fluid samples collected in vials as claimed in claim 6 wherein the packaging container has a square base and four sidewalls with a cylindrical neck having a diameter that is substantially equal to a diagonal of the square base.

9. An apparatus for packaging and shipping biological fluid samples collected in vials as claimed in claim 1 wherein the means for receiving and retaining the at least one vial include a plurality of the cylindrical cavities die cut from the top surface of the absorbent body, each cylindrical cavity being adapted to receive an associated vial.

10. An apparatus for packaging and shipping biological fluid samples collected in vials as claimed in claim 1 wherein the upturned side edges of the corrugated plastic board retainer provide a space between the retainer and the lid of the shipping container for a cooling compound to keep a fluid sample in the at least one vial frozen during shipping.

11. An apparatus for packaging and shipping biological fluid samples collected in vials as claimed in claim 1 wherein the shipping container comprises a polystyrene foam.

12. An apparatus for packaging and shipping biological fluid samples collected in vials as claimed in claim 1 wherein the shipping carton comprises a fiberboard.

13. An apparatus for packaging and shipping biological fluid samples collected in vials as claimed in claim 12, wherein the fiberboard shipping carton has an outer top cover which includes a flap hingedly connected to an outer edge thereof, the flap being forced down between a front wall of the shipping carton and a front wall of the shipping container, and a locking tab integral with the front wall of the shipping carton to lock the cover closed without the use of tape or other fasteners, the locking tab being inserted in a slit in the hinge that connects the flap to the outer top cover.

14. An apparatus for packaging and shipping biological fluid samples collected in vials, comprising:

a plurality of auto-absorbent bodies each having a bottom surface, a top surface and at least one sidewall, the top surface including a plurality of means that extend therefrom into the body for respectively receiving and retaining at least one vial;

a plurality of packaging containers that each surround and protect an associated one of the absorbent bodies and the vials received and retained therein;

a shipping container for surrounding and protecting two or more packaging containers, the shipping container including a lid and a retainer which cooperates with the lid for securing the two or more of the packaging containers therein so that the packaging containers are not displaced during shipping; and a shipping carton for surrounding and protecting the shipping container from damage during shipping.

15. An apparatus for packaging and shipping biological fluid samples collected in vials as claimed in claim 14 wherein the auto-absorbent bodies comprises a cellulose sponge.

16. An apparatus for packaging and shipping biological fluid samples collected in vials as claimed in claim 14 wherein the fluid samples are collected during drug trials.

17. An apparatus for packaging and shipping biological fluid samples collected in vials as claimed in claim 14 wherein the fluid samples are analyzed by automated robotic analyzers which remove the vials directly from the auto-absorbent body to analyze the contents thereof.

18. An apparatus for packaging and shipping biological fluid samples collected in vials as claimed in claim 14 wherein the retainer includes a board retainer having upturned side edges which cooperate with the lid of the shipping container.

19. An apparatus for packaging and shipping biological fluid samples collected in vials as claimed in claim 18 wherein the upturned side edges of the board retainer provide a space between the retainer and the lid of the shipping container for a cooling compound to keep a fluid sample in the vial frozen during shipping.

* * * * *